US007507890B1

(12) United States Patent
Sikra

(10) Patent No.: US 7,507,890 B1
(45) Date of Patent: Mar. 24, 2009

(54) SELF ADJUSTING DRUM LUG ASSEMBLIES

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 12/004,951

(22) Filed: Dec. 26, 2007

(51) Int. Cl.
*G10D 13/02* (2006.01)

(52) U.S. Cl. ..... 84/411 R

(58) Field of Classification Search ..... 84/411 R, 84/421, 417, 413, 411 A
See application file for complete search history.

(56) References Cited

U.S. PATENT DOCUMENTS

2007/0144332 A1* 6/2007 Chen ..... 84/422.1

* cited by examiner

*Primary Examiner*—Kimberly R Lockett
(74) *Attorney, Agent, or Firm*—William W. Haefliger

(57) ABSTRACT

A drum lug assembly, comprising, in combination first and second lugs attachable to the outer side of the drum shell, the lugs interconnected and defining aligned bores, and a receiver for a tensioning rod floatably coupling to at least one of the lugs.

14 Claims, 7 Drawing Sheets

SELF ADJUSTING DRUM LUG ASSEMBLIES

BACKGROUND OF THE INVENTION

This invention relates generally to the construction of drums, and more particularly to self-adjustable tensioning of drum heads to drum shells.

Drum heads are typically held onto opposite ends of drum shells by tensioning means at the outer sides of the shells. Such tensioning means typically include tensioning rods threadably connected to drum lugs. Those connections are fixed, and do not allow relative angular position adjustment as between rods and lugs. This can introduce problems, such as differential tensioning due to rod binding, as respects the multiple independently adjustable rods spaced about the drum shell, which can in turn cause undesirable differential tightening of the drum heads. This has been a problem in the past.

SUMMARY OF THE INVENTION

It is a major object of this invention to provide a simple and highly effective solution to the above problem. Basically, the invention is embodied in an assembly that comprises, at each rod location:

a) first and second lugs attachable to the outer side of the drum shell, b) said lugs having interfit and defining aligned bores, and c) a receiver for a tensioning rod floatably coupling to at least one of the lugs.

One or two receivers may be provided, for a tensioning rod or rods floatably coupling to at least one of the lugs, on either one side or both.

As will be seen, the receiver typically has a bore thread for coupling to the tensioning rod; and the rod is thread connected to said receiver bore thread, and extends in said aligned bores for limited sideward deflection in at least one of said aligned bores. This enables self adjustment of the rod relative to the lug or lugs as during rod tightening, this being is particularly effective in the case of rod mis-alignment with the lug bore.

Another object is to provide the receiver with a coupling flange, for floating coupling to one of the lugs, and a stem protruding relative to the flange, with clearance between the stem and one of the aligned bores, allowing limited lateral deflection therein, for self adjustment.

Yet another object includes provision of a non-metallic seat in the assembly to cushion flange endwise movement.

A further object includes provision of at least one of the lugs to have external oval configuration and defines a long oval axis generally parallel to said bores. Both lugs may have such configuration, to be fastened to the outer side of the shell. An elastomeric gasket or gaskets may provide cushioning between the lugs and shell, allowing further lug self adjustment during use. Dual lugs for dual retainers are also provided.

These and other objects and advantages of the invention, as well as the details of an illustrative embodiment, will be more fully understood from the following specification and drawings, in which:

DRAWING DESCRIPTION

DETAILED DESCRIPTION

Figure 1:
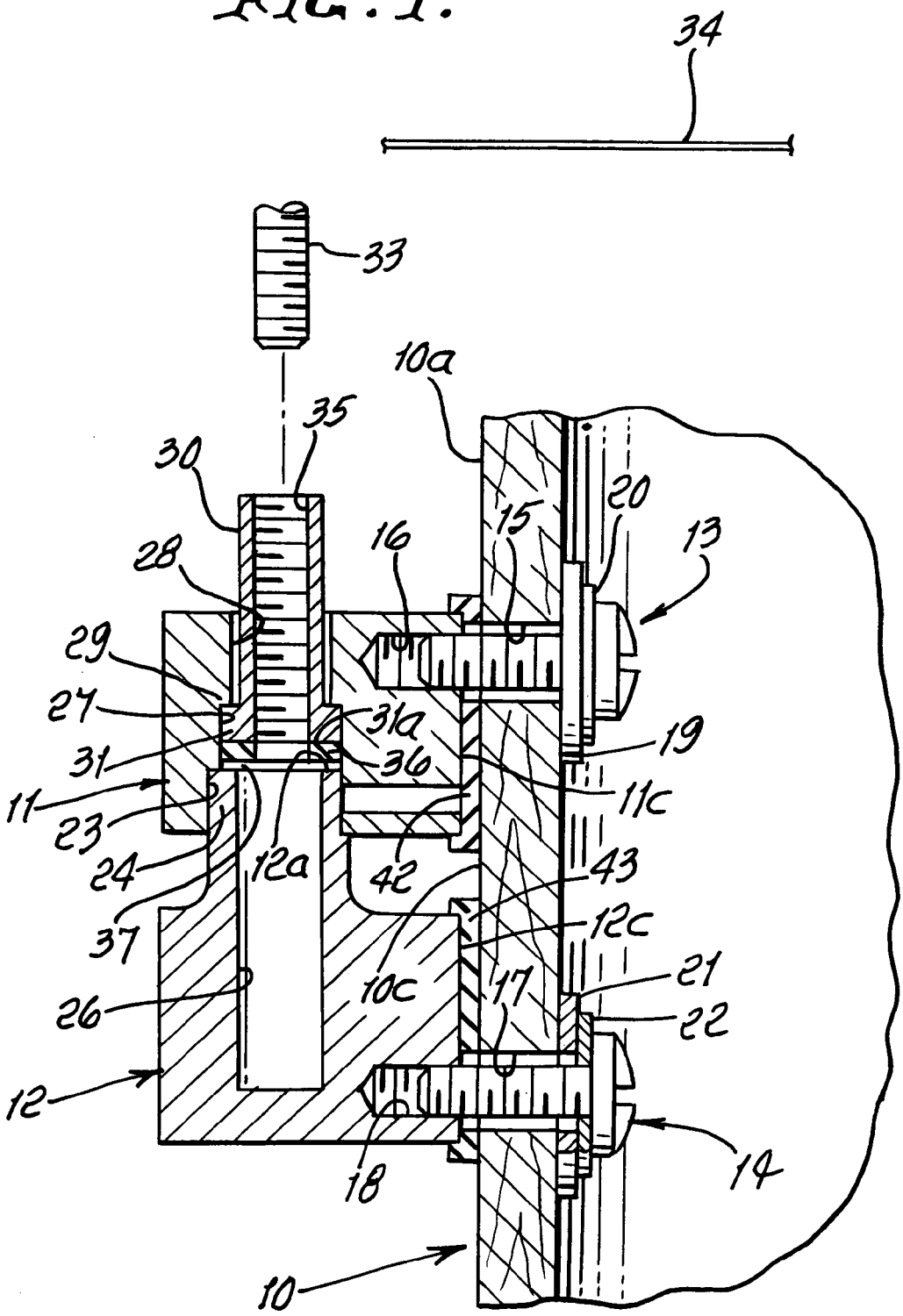
FIG. 1 is a section taken through lug apparatus.

Referring first to the preferred embodiment shown in FIG. 1, the drum shell 10 supports first and second lugs attached to the outer side 10*a* of the shell. One of such lugs is indicated at 11, and the other at 12. Threaded fasteners 13 and 14 are shown connecting the lugs to the shell outer side 10*a*, as via openings 15 and 16 in the shell and in lug 11, and as via openings 17 and 18 in the shell in lug 12. Washers are provided at 19 and 20, and at 21 and 22.

The lugs have interfit as at bore 23 in lug 11 receiving projection or stem 24 of lug 12. The lugs also have axially aligned bores, as at elongated bore 26 in lug 12, and stepped bores 27 and 28 in lug 11, there being a bore shoulder provided at 29, between 27 and 28.

A tubular receiver 30 is received in bores 27 and 28, and has a flange 31 engagable against shoulder 29. That receiver has a threaded bore 35 for threaded reception of an adjustable tensioning end 33, serving to tension a drum head schematically shown at 34. Multiple such rods are spaced about the shell, for individual rotary adjustments to precisely tune the drum head, whereby the rods may resultantly extend in slightly out of parallel relation. Such out of parallel relation is accommodated in simple effective manner by the present invention.

To this end, the receiver 30, connected to the tension rod, is floatably connected to the upper lug 11, to allow the tensioned rod and receiver 30 to angularly deflect sidewardly to become slightly mis-aligned with bores 26-28, in response to differential tightening of the multiple tensioner rods referred to, without causing interruption of tightening of the tension rod as could result from seizing or binding of the threaded connection between the rod and the receiver if no such lateral deflection were enabled. In this regard, axial loading is transmitted between flange 31 and shoulder 29. A non-metallic seating washer 36 is provided between the bottom surface 31*a* of flange 31 and the top 12*a* of lug 12, with clearance therebetween at 37, to allow angular mis-alignment of the washer and flange, relative to the axis of bore 27.

Figure 3:
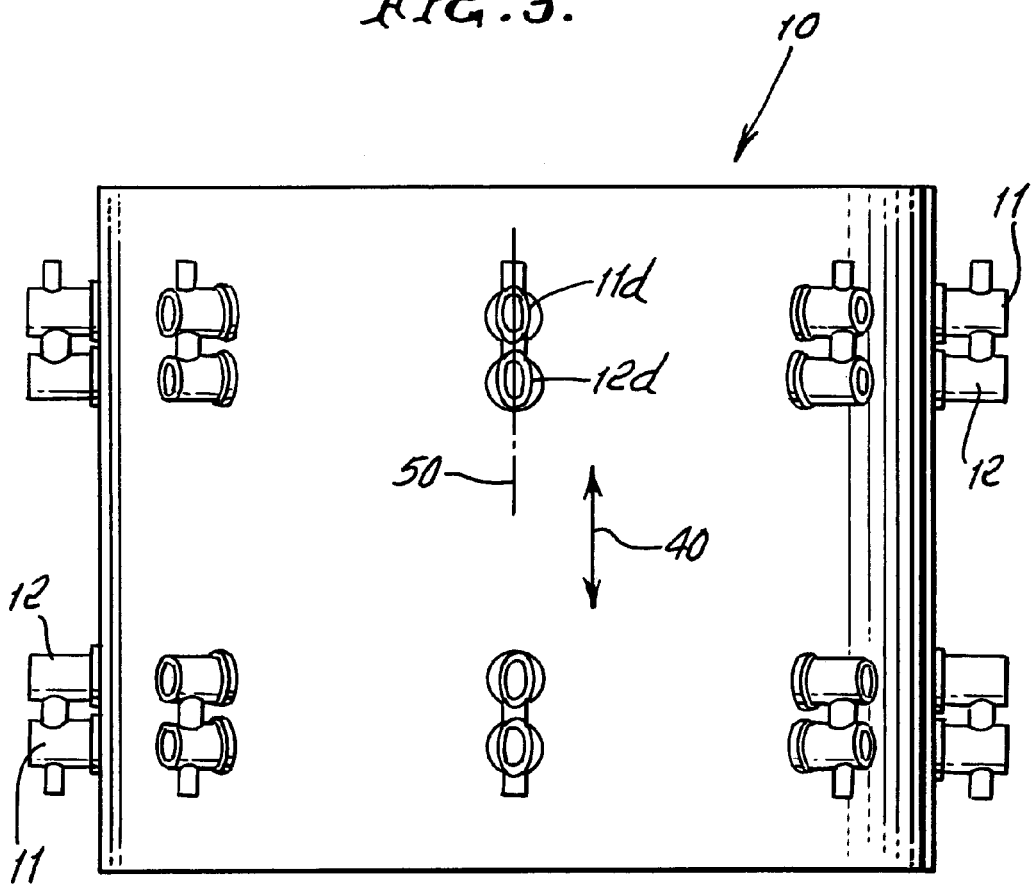

It will be understood that at least one of the lugs, and preferably both of them, may have external oval or rounded configuration, as seen at 11*d* and 12*d* in FIG. 3, defining an oval axis 50, or axes extending in the direction 40 parallel to the bores 26-28. This contributes to the interfit functioning of the lugs, as referred to. Also elastomeric gasket or gaskets 42 and 43 are positioned between the lug surfaces 11*c* and 12*c* and the curved outer surface 10*c* of the shell, whereby the metallic lugs and shell are insulated against audible sound transmission therebetween. Also, the lugs may slightly deflect relative to the shell, in response to tension rod differential tightening, as referred to, contributing to non-binding of the rods as they are tightened, in the manner referred to.

Figure 2:
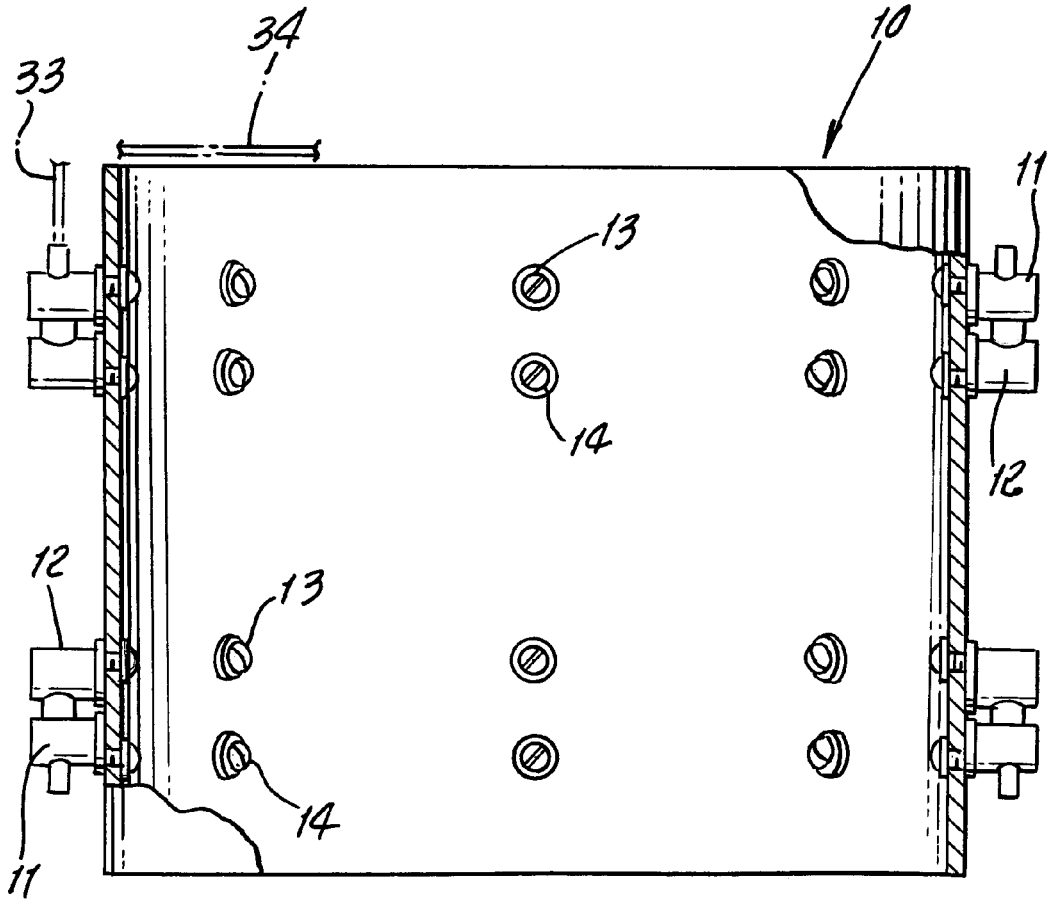
FIGS. 2 and 3 show lug positioning on a drum shell.
Figure 4:
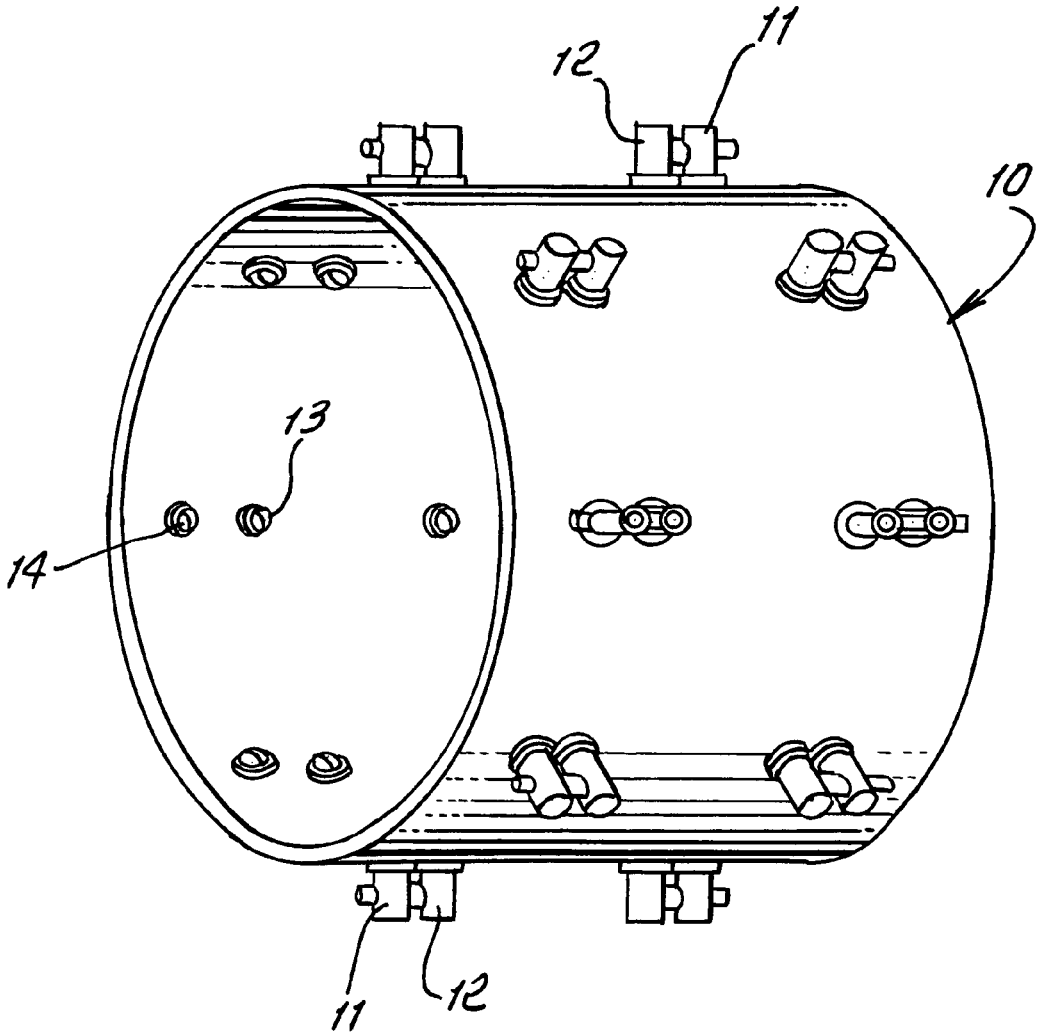
FIG. 4 is a schematic view in perspective of lugs on a shell.

FIGS. 2-4 show like pairs of lugs 11 and 12 extending in endwise opposite directions for adjustably tensioning rods extending to drum heads at opposite ends of the shell.

Figure 6:
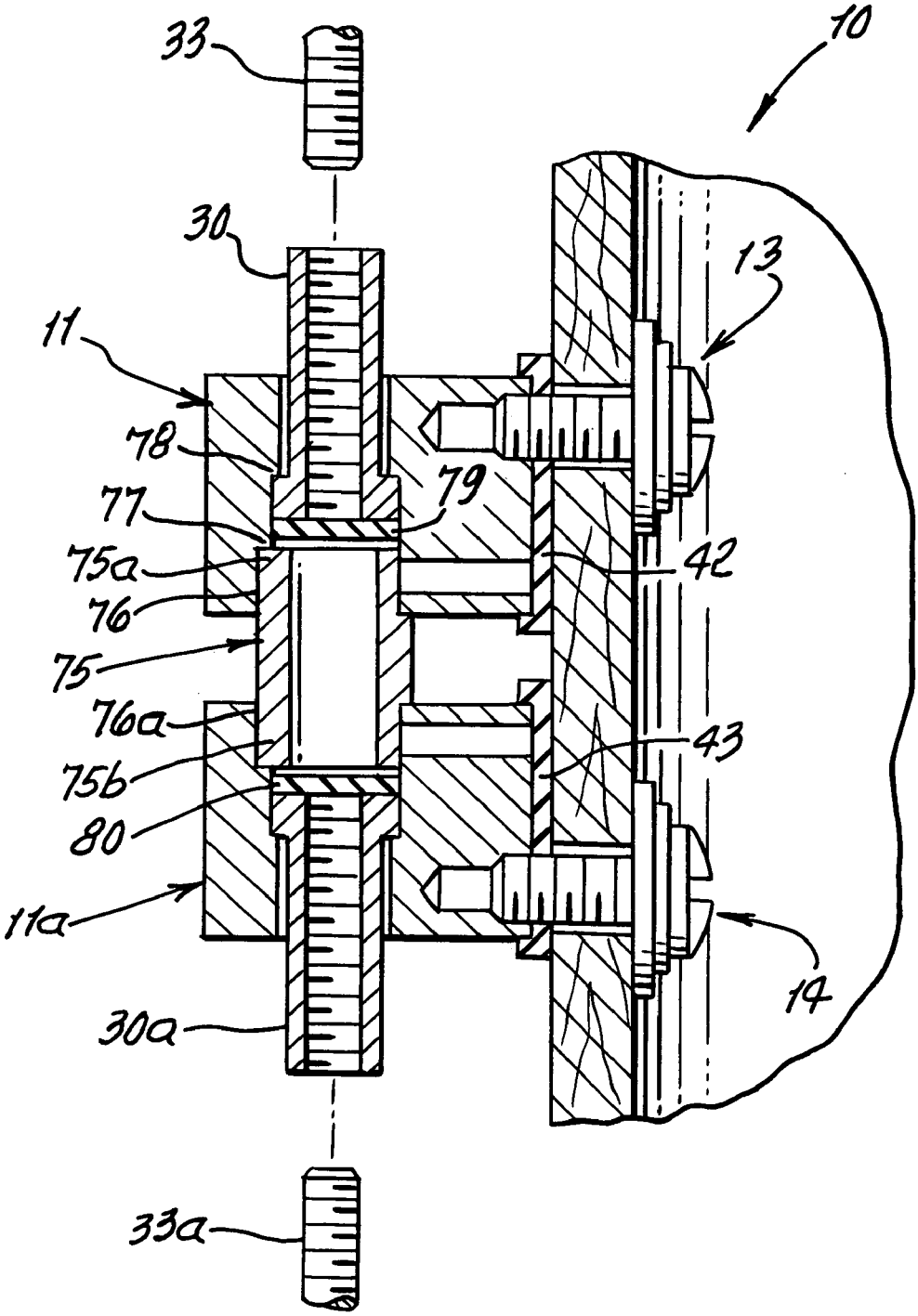
FIG. 6 is a section like FIG. 1, but showing a modification.
Figure 7:
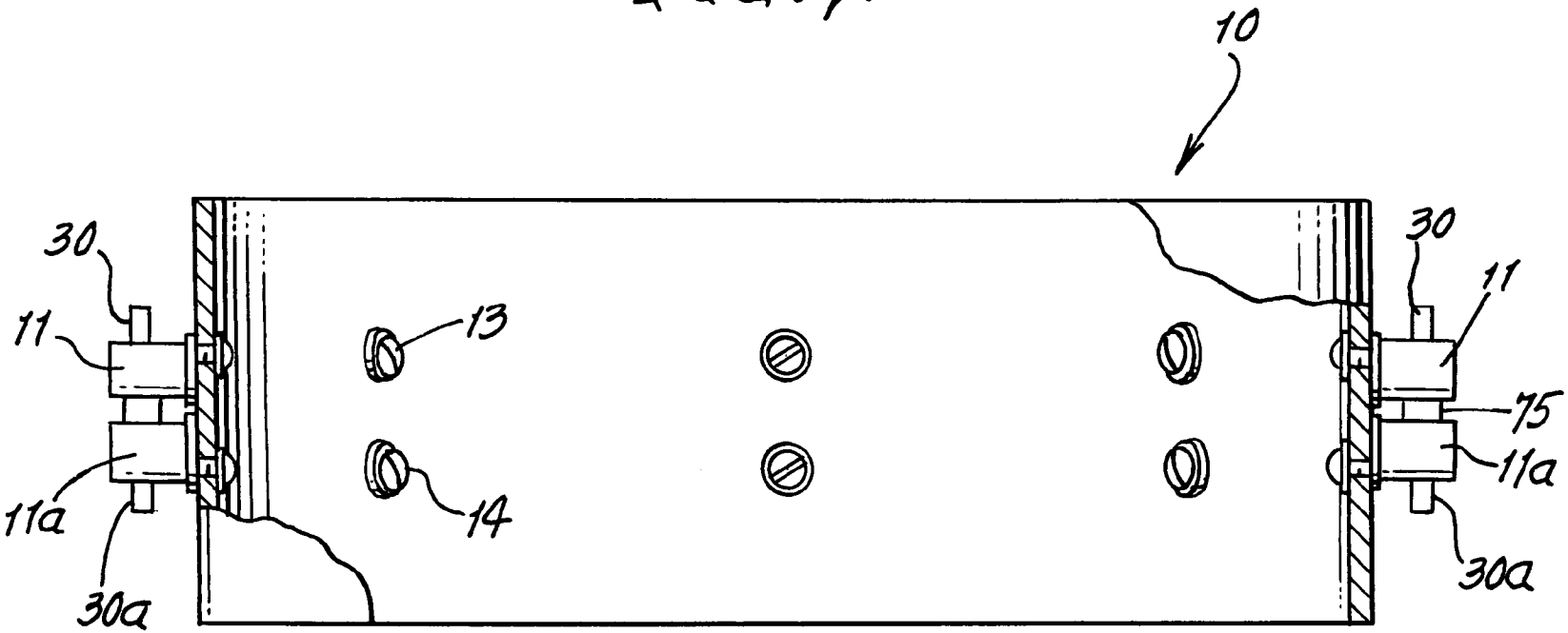
FIG. 7 is a view like FIG. 2, but showing FIG. 6 type modified lug attachments to a drum shell.

In FIGS. 6 and 7, elements the same as in FIGS. 2-4 are given the same identifying numerals. In FIGS. 6 and 7 the two lugs are identified as 11 and 11*a*, since the lower lug 11*a* is like lug 11, but endwise reversed. The lugs may have oval or rounded external configurations. Likewise, first and second receivers 30 and 30*a* are provided, and which are alike, but relatively endwise reversed. Upper and lower tensioning rods are indicated at 33 and 33*a*. Receiver 30 is floatably coupled to upper lug 11, and receiver 30*a* is floatably coupled to lower lug 11*a*. Rods 33 and 33*a* extend toward opposite ends of the drum shell to adjustably tension drum heads at those ends.

Also provided is a tubular connector component 75 having opposite ends 75*a* and 75*b* connected to the lugs, as at 76 and 76*a*, to extend between and in alignment with the receivers 30 and 30*a*. Component 75 acts as a spacer to position the lugs in endwise spaced relation, and distributing endwise force in balanced relation and as between the fasteners which connect the lugs to the drum shell. Each lug has spaced and stepped shoulders, as at 77 and 78 engagable with shoulders on the component and on the receiver, to transmit such axial loading, in balanced relation as between the lugs, but allowing for floating deflection.

In addition, plastic compressive seating cushions or inserts 79 and 80 are located between the ends of the receivers, and of the component 75, to allow each receiver to angularly deflect sidewardly to limited extent, as provided by the clearance between the receiver shaft and the lug bore, as previously discussed. Dual independent deflection of the receivers allows for maximum sideward self-adjustability during endwise adjustment of the rods 33 and 33*a*, preventing binding. The configuration of FIGS. 6 and 7 is preferred.

Figure 5:
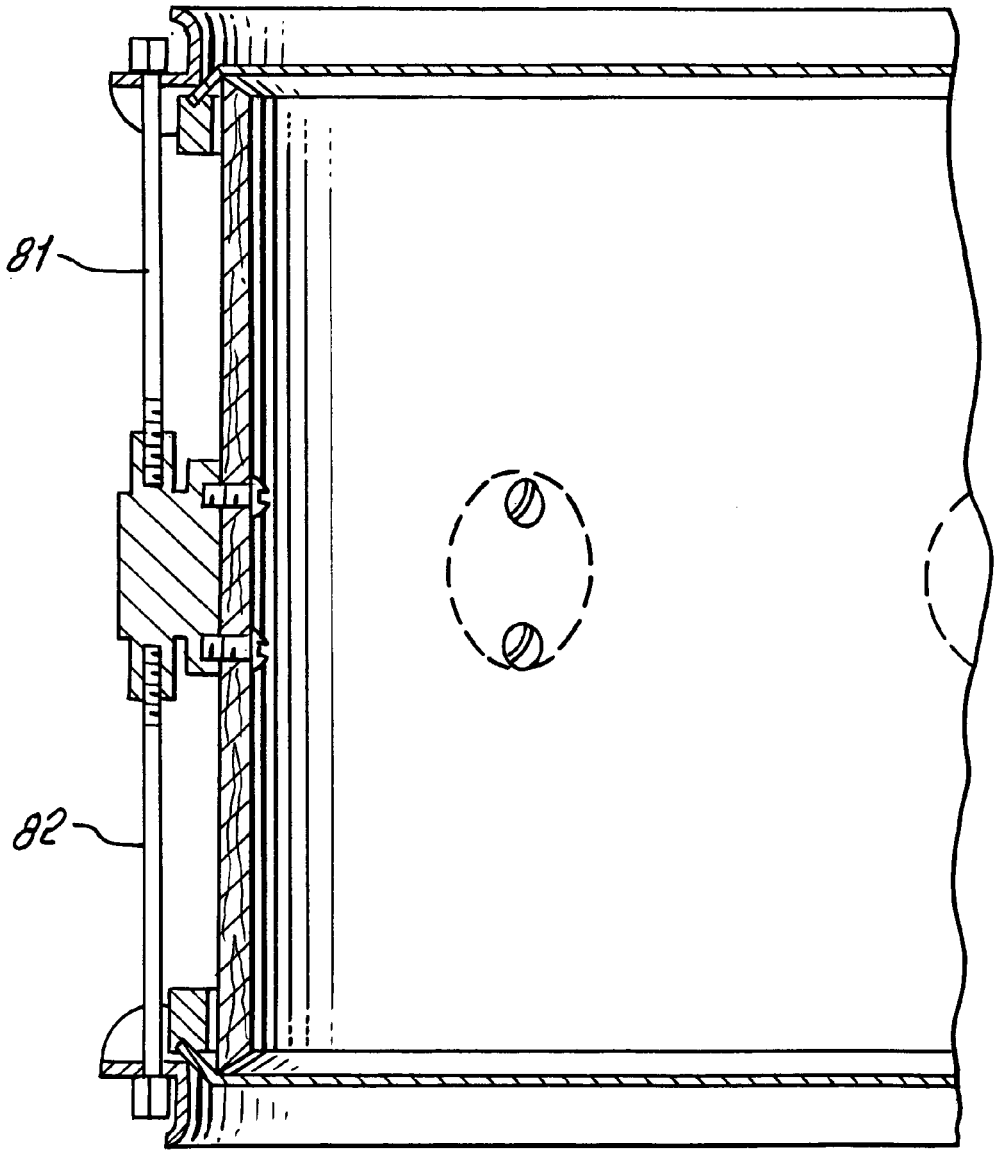
FIG. 5. PRIOR ART
FIG. 5 is a section showing a prior art shell and drum heads.

FIG. 5 shows a prior art rod 81 and 82 configuration at the side of a drum shell.

I claim:

1. A drum lug assembly, comprising, in combination a) first and second lugs attachable to the outer side of the drum shell, b) said lugs interconnected and defining aligned bores, and c) a receiver for a tensioning rod floatably coupling to at least one of the lugs, d) the receiver having a coupling flange and a tubular stem received with clearance in one of said aligned bores, for limited lateral deflection therein, said flange having a diameter greater than the outer diameter of said stem, said clearance defined between the stem outer diameter and the diameter of said one bore.

2. The combination of claim 1 wherein the receiver has a bore thread for coupling to the tensioning rod.

3. The combination of claim 2 wherein the rod is thread connected to said receiver bore thread, and extends in said aligned bores for limited sideward deflection in at least one of said aligned bores.

4. The combination of claim 1 wherein the receiver has a bore thread for coupling to the tensioning rod.

5. The combination of claim 4 wherein the rod is thread connected to said receiver bore thread, and extends in said aligned bores for limited sideward deflection in at least one of said aligned bores.

6. A drum lug assembly, comprising, in combination a) first and second lugs attachable to the outer side of the drum shell, b) said lugs interconnected and defining aligned bores, and c) a receiver for a tensioning rod floatably coupling to at least one of the lugs, d) and including a plastic seat in the assembly to cushion the flange, and add tension to receiver bore threading.

7. The combination of claim 1 wherein at least one of the lugs has external oval or rounded configuration defining a long axis generally parallel to said bores.

8. The combination of claim 7 wherein each of the lugs has external oval configuration and defines a long oval axis generally parallel to said bores.

9. The combination of claim 1 including a drum shell to which said lugs are fastened at the outer side of the shell.

10. A drum lug assembly, comprising, in combination a) first and second lugs attachable to the outer side of the drum shell, b) said lugs interconnected and defining aligned bores, and c) a receiver for a tensioning rod floatably coupling to at least one of the lugs, d) and including a drum shell to which said lugs are fastened at the outer side of the shell, e) and including an elastomeric gasket or gaskets positioned between the lugs and the shell and compressed therebetween.

11. The combination of claim 1 wherein there are like pairs of said assemblies attached to the shell outer surface, and spaces in endwise alignment, at the outer side of the shell.

12. The combination of claim 1 wherein said receiver is a first receiver for a first tensioning rod floatably coupled to the first leg, and there being a second receiver for a second tensioning rod floatably coupled to the second lug.

13. The combination of claim 12 wherein said receivers project in endwise opposite directions, and there being a tubular component having opposite ends connected to said lugs, endwise between the receivers, and acting as a spacer to position said lugs in endwise spaced relation.

14. A drum lug assembly, comprising, in combination a) first and second lugs attachable to the outer side of the drum shell, b) said lugs interconnected and defining aligned bores, and c) a receiver for a tensioning rod floatably coupling to at least one of the lugs, d) and wherein said receiver is a first receiver for a first tensioning rod floatably coupled to the first leg, and there being a second receiver for a second tensioning rod floatably coupled to the second lug, e) and wherein said receivers project in endwise opposite directions, and there being a tubular component having opposite ends connected to said lugs, endwise between the receivers, and acting as a spacer to position said lugs in endwise spaced relation, f) and including a plastic cushion between each receiver and said tubular component, allowing the receiver to deflect sidewardly to limited extent.

* * * * *